US007478453B1

(12) United States Patent
Busshaus

(10) Patent No.: US 7,478,453 B1
(45) Date of Patent: Jan. 20, 2009

(54) DUSTER WITH EXTENSION HANDLE

(76) Inventor: Mary Ann Busshaus, 959 Watt Rd., Apollo, PA (US) 15613

( * ) Notice: Subject to any disclaimer, the term of this patent is extended or adjusted under 35 U.S.C. 154(b) by 338 days.

(21) Appl. No.: 10/671,963

(22) Filed: Sep. 26, 2003

(51) Int. Cl.
*A47L 13/24* (2006.01)

(52) U.S. Cl. ..... 15/228; 15/209.1; 15/210.1; 15/147.1; 15/147.2; 15/146; 15/144.3

(58) Field of Classification Search ..... 15/228, 15/229.1–229.4, 229.6–229.8, 160, 154, 15/146, 209.1, 147.2, 210.1, 147.1, 144.3, 15/145
See application file for complete search history.

(56) References Cited

U.S. PATENT DOCUMENTS 1,648,809 A * 11/1927 Hillyard ..... 15/229.4
1,977,473 A * 10/1934 Edwards ..... 15/229.4
2,141,336 A * 12/1938 Bailey ..... 15/147.2
2,621,497 A * 12/1952 Davie ..... 15/257.9
3,037,230 A * 6/1962 Strand et al. ..... 15/229.3
3,230,565 A * 1/1966 Koch ..... 15/229.8
4,765,014 A * 8/1988 Moss et al. ..... 15/229.3

* cited by examiner

*Primary Examiner*—Gary K Graham

(57) ABSTRACT

The present invention is for a duster with an extension handle for allowing the user to clean in hard to reach areas. This unique device provides an easier method of removing dust, dirt, cobwebs, and other debris from the tops of door and window frames, ceilings, ceiling fan blades, behind appliances and hard to move pieces of furniture, picture frames, and other hard to reach places. Many users, including short, pregnant, elderly, or disabled people, as well as any person having a limited range of mobility, would benefit from the use of this product. The duster with extension handle would consist of a long, plastic handle with a series of detachable cleaning heads and a handle extension that provides additional reaching capability. One such cleaning head would feature a flexible wire-coated piece that would be used in conjunction with various removable fabric covers for cleaning. The flexible piece could be bent at various angles for maximum cleaning benefit. The extension handle would allow the user to clean hard to reach areas of the home with ease and minimal effort.

12 Claims, 2 Drawing Sheets

DUSTER WITH EXTENSION HANDLE

BACKGROUND OF THE INVENTION

1. Field of the Invention

The present invention relates to a duster with extension handle for use in connection with cleaning in hard to reach places. The duster with extension handle has particular utility in connection with cleaning spider webs from ceilings and high corners, dusting behind refrigerators and stoves, cleaning baseboards behind beds, and straightening curtains and draperies.

2. Description of the Prior Art

Dusters with extension handles are desirable for providing an easier method of removing dust, dirt, cobwebs, and other debris from the top of door and window frames, ceilings, ceiling fan blades, behind appliances and hard to move pieces of furniture, picture frames, and other hard to reach places. This type of cleaning device would be beneficial to short, pregnant, elderly, or disabled-people, as well as to any-person having a limited range of mobility. The extension handle would allow the user to clean hard to reach areas of the home with ease and minimal effort.

The use of cleaning implements attached to handles is known in the prior art. For example, U.S. Pat. No. 4,457,038 to Dennis A. Hammond discloses a handle for disposable brush or mop head. However, the Hammond '038 patent does not allow a user to simply change the covering of the head, instead requiring the entire head of the device to be replaced, leading to higher cost of replacement parts since the internal structure of the head must be replaced along with the covering. Additionally, the Hammond '038 device makes no provision for extending the length of the handle for cleaning hard to reach areas.

U.S. Pat. No. 3,651,534 to Ragnvald G. Leland discloses a cleaning device with interchangeable head in which the handle and interchangeable pad are secured by the same resilient member. However, the Leland '534 patent proposes a flat rectangular cleaning head and not an angled surface for cleaning hard to navigate areas, and additionally makes no provision for extending the length of the handle for cleaning hard to reach areas.

Similarly, U.S. Pat. No. 3,600,740 to Lois J. Ogier discloses a home cleaning system that utilizes a common telescoping handle for attachment to a wet mop, dry mop, dust mop, and broom attachment. However, the Ogier '740 patent does not allow a user to simply change the covering of the head, instead requiring the entire head of the device to be replaced, leading to higher cost of replacement parts since the internal structure of the head must be replaced along with the covering. Furthermore, the Ogier '740 device makes no provision for an angled cleaning head for use in hard to navigate areas, such as between walls and beds, under the edges of heavy furniture and appliances, and the tops of ceiling fan blades.

U.S. Pat. No. Des.335, 914 to Hamilton M. Walker discloses the ornamental design for a fish snare that consists of a retractable wire noose on the end of a pole. Although the Walker '914 patent utilizes a wire loop, it makes no provision for angling the loop to aid in reaching hard to get to locations. Additionally the Walker '914 device has no means for extending the length of the pole for increasing the number of areas the user can reach.

Likewise, U.S. Pat. No. 3,423,781 to H. H. Henson discloses a securement for mop on broom heads in which the head is secured to a dowel which fits into a cylindrical, spring-loaded sleeve secured to the bottom end of a permanent handle. However, the Henson '781 patent requires that the entire attachment head be removed and does not provide an internal structure for the attachment head that can be retained while discarding the covering of the structure. This leads to increased cost of replacement parts. Furthermore, the Henson '781 device makes no provision for extending the length of the handle for cleaning hard to reach areas.

Lastly, U.S. Pat. No. 3,949,514 to Frank J. Ramsey discloses a spring operated, trigger released snare for catching fish, frogs, snakes, and other small animals. However, the Ramsey '514 patent makes no provision for angling the loop to aid in reaching hard to get to locations. Additionally the Ramsey '514 device has no means for extending the length of the pole for increasing the number of areas the user can reach.

While the above-described devices fulfill their respective, particular objectives and requirements, the aforementioned patents do not describe a duster with extension handle that allows the user to clean in hard to reach and hard to navigate places. The Hammond '038 and Ogier '740 patents do not allow a user to simply change the covering of the head, instead requiring the entire head of the device to be replaced, leading to higher cost of replacement parts since the internal structure of the head must be replaced along with the covering. The Hammond '038, Leland '534, Walker '914, Henson '781, and Ramsey '514 devices make no provision for extending the length of the handle for cleaning hard to reach areas. Finally, the Leland '534, Ogier '740, Walker '914, and Ramsey '514 patents make no provision for an angled cleaning head for cleaning in hard to navigate areas.

Therefore, a need exists for a new and improved duster with extension handle that can be used for removing dust, dirt, cobwebs, and other debris form the top of door and window frames, ceilings, ceiling fan blades, behind appliances and hard to move pieces of furniture, picture frames, and other hard to reach places. In this regard, the present invention substantially fulfills this need. In this respect, the duster with extension handle according to the present invention substantially departs from the conventional concepts and designs of the prior art, and in doing so provides an apparatus) primarily developed for the purpose of allowing the user to clean in hard to reach and hard to navigate places without an undue amount of effort.

SUMMARY OF THE INVENTION

In view of the foregoing disadvantages inherent in the known types of cleaning implements with extension handles now present in the prior art, the present invention provides an improved duster with extension handle, and overcomes the above-mentioned disadvantages and drawbacks of the prior art. As such, the general purpose of the present invention, which will be described subsequently in greater detail, is to provide a new and improved duster with extension handle which has all the advantages of the prior art mentioned heretofore and many novel features that result in a duster with extension handle which is not anticipated, rendered obvious, suggested, or even implied by the prior art, either alone or in any combination thereof.

To attain this, the present invention essentially comprises a hollow handle attached to either an extension piece or a cleaning head by a press button method. The cleaning head has a flexible wire loop that can be bent at various angles for maximum cleaning benefit and is covered by a removable cloth cover.

There has thus been outlined, rather broadly, the more important features of the invention in order that the detailed description thereof that follows may be better understood and in order that the present contribution to the art may be better appreciated.

The invention may also include the discussion of various attachment means for the cover, such as hook and loop fasteners or snaps. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved duster with extension handle that has all of the advantages of the prior art cleaning implements with handles and none of the disadvantages.

It is another object of the present invention to provide a new and improved duster with extension handle that may be easily and efficiently manufactured and marketed.

An even further object of the present invention is to provide a new and improved duster with extension handle that has a low cost of manufacture with regard to both materials and labor, and which accordingly is then susceptible of low prices of sale to the consuming public, thereby making such a duster with extension handle economically available to the buying public.

Still another object of the present invention is to provide a new duster with extension handle that provides in the apparatuses and methods of the prior art some of the advantages thereof, while simultaneously overcoming some of the disadvantages normally associated therewith.

Even still another object of the present invention is to provide a duster with extension handle for allowing the user to clean in hard to reach areas. This provides a user with limited mobility and flexibility the capability of cleaning high areas as well as hard to navigate areas.

Lastly, it is an object of the present invention to provide a new and improved duster with extension handle which allows the user to clean hard to reach areas quickly and efficiently with a minimal amount of effort.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
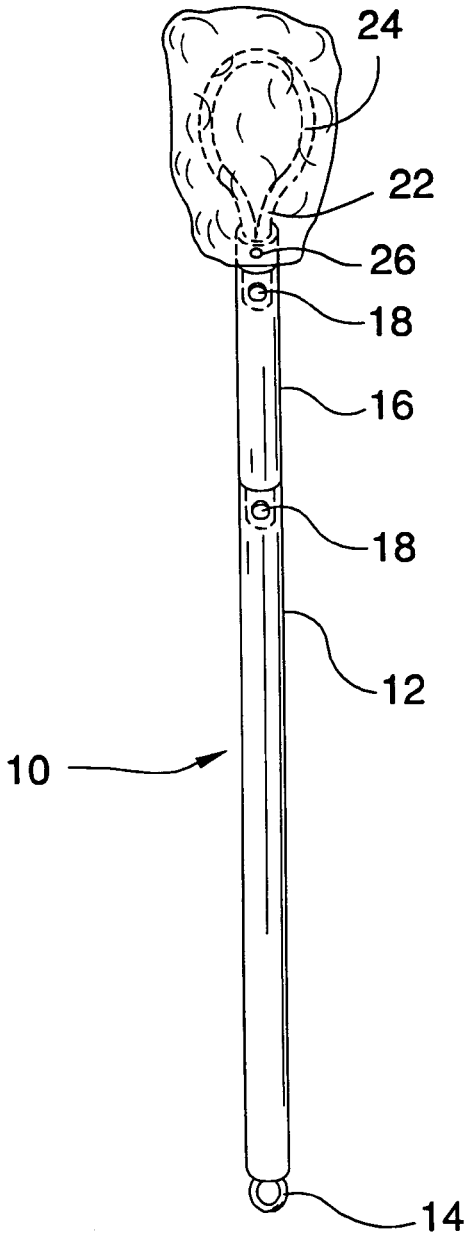
FIG. 1 is a front elevation view of the preferred embodiment of the duster with extension handle constructed in accordance with the principles of the present invention.
Figure 3:
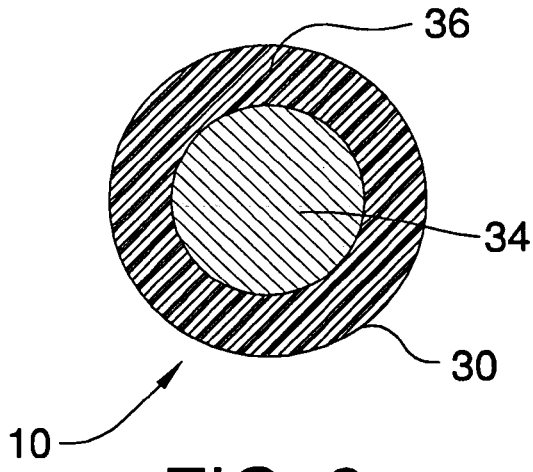
FIG. 3 is a radial sectional view of the flexible wire structure of the duster with extension handle of the present invention.
Figure 2:
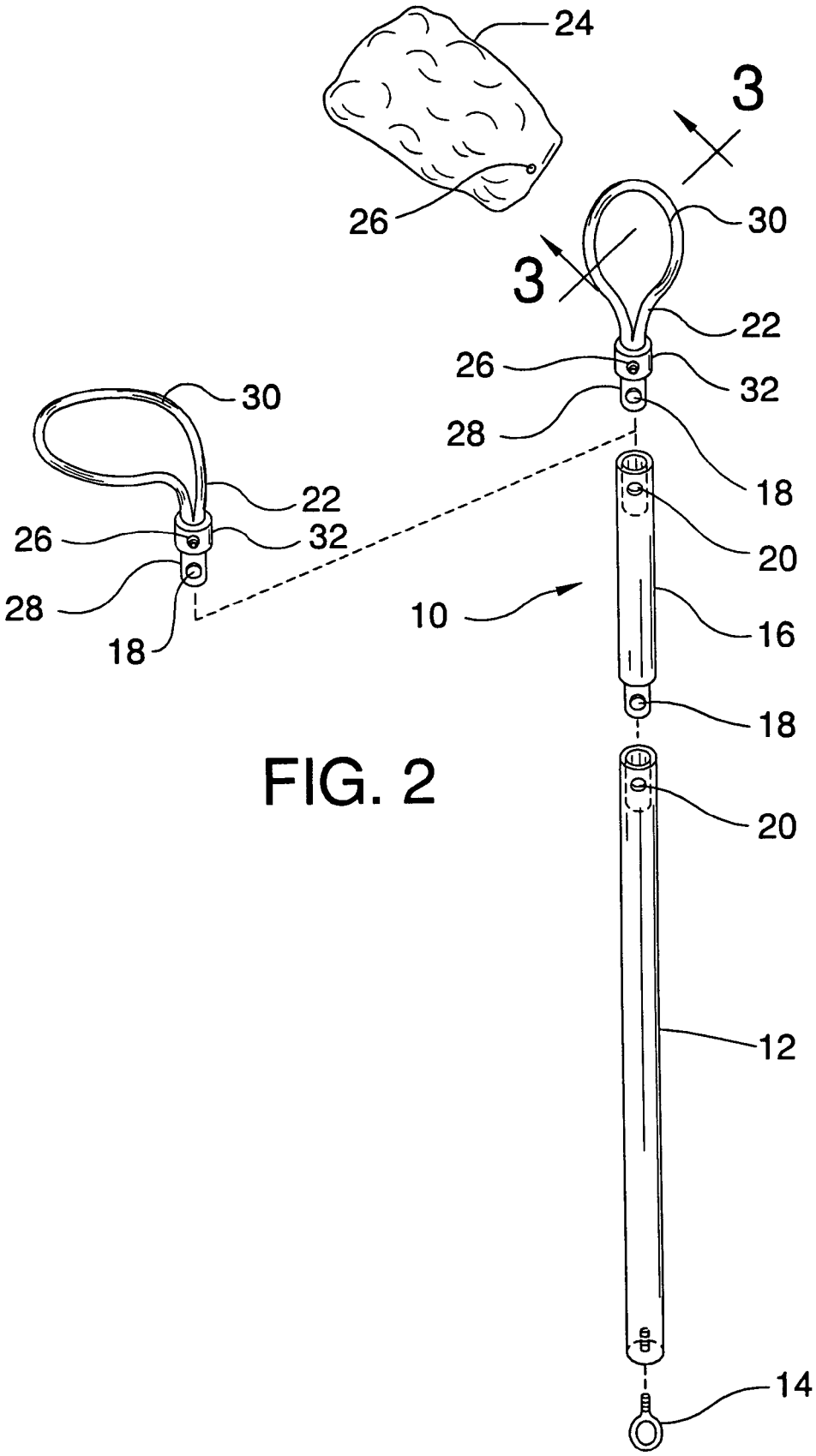
FIG. 2 is an exploded view of the parts of the duster with extension handle of the present invention.

Referring now to the drawings, and particularly to FIGS. 1-3, a preferred embodiment of the duster with extension handle of the present invention is shown and generally designated by the reference numeral 10.

In FIG. 1, a new and improved duster with extension handle 10 of the present invention for cleaning in hard to reach places is illustrated and will be described. More particularly, the duster with extension handle 10 has a lightweight plastic handle 12 with an eye bolt 14 inserted in one end so the duster 10 can be hung in a closet for storage. Mounted on the other end of the handle 12 is the handle extension 16, made of the same material as the handle 12, which extends the reach of the handle 12. The handle extension 16 is secured to the handle 12 by a release button 18 that snaps into an attachment hole 20 at the top of the handle 12. When the release button 18 is pushed in, the handle extension 16 can be removed from the handle 12. The attachment head 22 is secured to either the handle extension 16 or the handle 12 in a similar manner. Located on the end of the attachment head 22 is a release button 18 which is identical in size and function to the release button 18 on the extension handle 16. The attachment head 22 is covered with a lamb's wool cover 24 for dusting. The cover 24 is detachable and is secured to the attachment head with a set of fasteners 26, preferably snaps or hook and loop fasteners, one part of which is attached to the cover 24 and the remainder of which is attached to the attachment head 22.

FIG. 2 shows an exploded view of the parts of the duster with extension handle 10. The eye bolt 14 is inserted into the bottom of the handle 12. The handle extension 16 attaches to the handle 12 through a release button 18 which pops into the attachment hole 20 on the top of the handle 12. The handle extension 16 is equipped with a similar attachment hole 20 such that the attachment head 22 can be mounted on either the handle 12 or the handle extension 16, providing a variety of handle lengths from which to choose. The attachment head 22 has a base 28 connected to a flexible wire loop 30 with a collar 32 to maintain the integrity of the connection. Located on the base 28 is a release button 18 similar to the one on the handle extension 16. A dusting cover 24 is available to place over the wire loop 30 and is secured by fasteners 26, one part of which is attached to the cover 24 and the remainder of which is attached to the collar 32 of the attachment head 22.

FIG. 3 is a sectional view of the wire loop 30 taken from a radial vantage point. The nature of the wire loop 30 can be seen to be a flexible wire 34 surrounded by a plastic coating 36. The flexibility of the wire 34 allows the wire loop 30 to be bent at various angles for different cleaning situations, and the plastic coating keeps the wire from rusting should cleaners or water be applied to the cover during the cleaning process.

In use, it can now be understood that the user would determine the most beneficial length for the duster with extension handle 10. One of three configurations would result. The longest configuration would require the user to mount the handle extension 16 on the handle 12 by pressing the release button 18 on the handle extension 16 and inserting it into the attachment hole 20 on the handle 12. The user would then follow the same procedure to mount the attachment head 22 on the handle extension 16. The wire loop 30 could then be bent to the desired angle, a cover 24 would then be snapped onto the attachment head 22, and the user could start cleaning. The attachment head 22 could also be used on either the handle 12 or handle extension 16 by itself. The cover 24 could be replaced when worn by simply releasing the fasteners 26 and placing a new cover 24 on the wire loop 30.

While a preferred embodiment of the duster with extension handle has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of wood may be used for the handle instead of the lightweight plastic described. Also, the dusting cover may be made of any soft material which is suitable for a dusting cloth. Additionally, other types of attachment heads, such as a dry mop, wet mop, broom, scrub brush, and the like could be attached to in place of the wire loop herein described. And although aiding the user in cleaning hard to reach and navigate areas has been described, it should be appreciated that the duster with extension handle herein described is also suitable for straightening curtains, reaching items at the top of a closet, reaching into trees, painting ceilings or the tops of walls, and various other functions that require a step ladder or full extension of the arm to accomplish.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning implement with handle extension comprising:

an elongated hollow handle having a bottom end and a top end, wherein said handle forms a transverse aperture near said top end and a longitudinal aperture on said bottom;

an eye bolt connected to said handle such that it passes through said longitudinal aperture on said bottom end of said handle;

a plurality of first attachment means, at least one of said first attachment means being connected to said top end of said handle;

a semi-rigid, flexible cleaning attachment having a top portion and a bottom portion and formed such that it is cylindrical on said bottom portion and has a loop shape on said top portion and connected to said first attachment means;

an attachment collar connected to said cleaning attachment;

a cover connected to said attachment collar;

a second attachment means connected to said attachment collar and to said cover for the purpose of removably securing said cover to said attachment collar.

2. The cleaning implement with handle extension of claim 1 wherein said handle is cylindrically shaped with a diameter slightly larger than that of said cylindrically shaped bottom portion of said cleaning attachment such that said bottom portion of said cleaning attachment could slide into said top end of said handle for coupling.

3. The cleaning implement with handle extension of claim 1 wherein said longitudinal aperture on said bottom end of said handle and said eye bolt are adapted for threaded coupling.

4. The cleaning implement with handle extension of claim 1 wherein said at least one first attachment means further comprises:

a push button having a raised and depressed position and connected to said bottom portion of said cleaning attachment such that when said button is placed in said depressed position, said bottom portion of said cleaning attachment can slide into said top end of said handle such that said push button will attain its raised position when said push button lines up with said transverse aperture near said top end of said handle forming a secure releasable attachment.

5. The cleaning implement with handle extension of claim 4 further comprising:

an elongated hollow cylindrical handle extension having a bottom end and a top end and approximately the same diameter as said handle and formed such that said handle extension is of a length shorter than that of said handle and has a transverse aperture near said top end and having an extension on said bottom end that is cylindrical but not hollow, said extension of a diameter slightly less than that of said handle such that said extension could slide into said top end of said handle for coupling and connected to said at least one said first attachment means on said bottom extension of said handle extension.

6. The cleaning implement with handle extension of claim 5 wherein said bottom end of said handle extension is connected to said top end of said handle through said at least one first attachment means and said top of said handle extension is connected to another bottom portion of said cleaning attachment through said first attachment means.

7. The cleaning implement with handle extension of claim 4 wherein said attachment collar is hollow and cylindrically shaped, having an interior and exterior surface, and has approximately the same diameter as said handle and is connected to said cleaning attachment such that said cylindrically shaped bottom portion of said cleaning attachment passes through said hollow portion of said attachment collar such that said push button on said cleaning attachment is below said attachment collar and said loop-shaped top portion of said cleaning attachment is above said attachment collar.

8. The cleaning implement with handle extension of claim 7 wherein said cover is formed of two layers and has an inside, an outside, two sides, a top, and a bottom and is formed such that said cover is closed on said top and said sides and open on said bottom and is of sufficient dimension to completely cover said loop-shaped top portion of said cleaning attachment with said bottom extending to said attachment collar.

9. The cleaning implement with handle extension of claim 8 wherein said second attachment means further comprises:

a plurality of fasteners having two parts such that said first part is connected to said cover near said bottom of said inside of said cover and said second part is connected to said exterior surface of said attachment collar such that when said first part is coupled with said second part, a secure and releasable attachment is formed.

10. The cleaning implement with handle extension of claim 9 wherein said second attachment means is a hook and loop fastener.

11. The cleaning implement with handle extension of claim 9 wherein said second attachment means is a two-part snap.

12. The cleaning implement with handle extension of claim 1 wherein said loop-shaped top portion of said cleaning attachment is made of plastic coated flexible wire such that said top portion of said cleaning attachment can be bent at various angles for maximum cleaning efficiency without diminished planar cleaning surface.

* * * * *